US011693337B2

(12) United States Patent
Fujii et al.

(10) Patent No.: US 11,693,337 B2
(45) Date of Patent: Jul. 4, 2023

(54) DEVELOPING DEVICE INCLUDING DEVELOPMENT CONTAINER, DEVELOPER CARRIER, AND RESTRICTING BLADE, AND IMAGE FORMING APPARATUS INCLUDING THE SAME

(71) Applicant: KYOCERA Document Solutions Inc., Osaka (JP)

(72) Inventors: Seia Fujii, Osaka (JP); Masakazu Uehara, Osaka (JP); Rei Yamagishi, Osaka (JP); Hiroaki Kitagawa, Osaka (JP); Takuya Kawasumi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/700,307

(22) Filed: Mar. 21, 2022

(65) Prior Publication Data

US 2022/0342349 A1 Oct. 27, 2022

(30) Foreign Application Priority Data

Apr. 27, 2021 (JP) ..... 2021-074707

(51) Int. Cl.
*G03G 15/08* (2006.01)

(52) U.S. Cl.
CPC ..... *G03G 15/0891* (2013.01); *G03G 15/0812* (2013.01); *G03G 15/0898* (2013.01); *G03G 15/0817* (2013.01); *G03G 2215/0866* (2013.01); *G03G 2215/0872* (2013.01)

(58) Field of Classification Search
CPC ..... G03G 15/0891; G03G 15/0812; G03G 15/0817; G03G 15/0898; G03G 2215/0866; G03G 2215/0872
See application file for complete search history.

(56) References Cited

U.S. PATENT DOCUMENTS

2009/0035011 A1* 2/2009 Delcamp ..... G03G 15/0817 399/106

FOREIGN PATENT DOCUMENTS

JP 2018-091892 A 6/2018

* cited by examiner

*Primary Examiner* — Arlene Heredia
*Assistant Examiner* — Laura Roth
(74) *Attorney, Agent, or Firm* — Stein IP, LLC

(57) ABSTRACT

The developing device includes a development container, a developer carrier, and a restricting blade. The development container has an opening. The developer carrier has a development area. The development container includes a pair of side frames, and a pair of side wall portions. In each of the pair of side wall portions, a seal member insertion hole extending through in the rotation-axial direction is formed at a position facing an end edge of the restricting blade in the rotation-axial direction. The developing device includes a blade-side side seal inserted in the seal member insertion hole to block a gap between the restricting blade and the side wall portion.

6 Claims, 8 Drawing Sheets

DEVELOPING DEVICE INCLUDING DEVELOPMENT CONTAINER, DEVELOPER CARRIER, AND RESTRICTING BLADE, AND IMAGE FORMING APPARATUS INCLUDING THE SAME

INCORPORATION BY REFERENCE

This application is based upon and claims the benefit of priority from the corresponding Japanese Patent Application No. 2021-074707 filed on Apr. 27, 2021, the entire contents of which are incorporated herein by reference.

BACKGROUND

The present disclosure relates to a developing device and an image forming apparatus including the developing device.

Image forming apparatuses, such as copiers, printers, facsimiles, and multifunction peripherals in combination of those devices, with use of the electrophotographic system, are equipped with a developing device for developing an electrostatic latent image formed on an outer circumferential surface of an image carrier, i.e., for forming a toner image (visible image) elicited from an electrostatic latent image.

The developing device includes a development container for containing developer including toner, and a developer carrier placed in contact with or proximity to an image carrier and being for carrying the developer. The development container has a container opening which is opened downstream of the development container relative to a moving direction inside an image forming apparatus under a condition that the developing device has been fitted to the image forming apparatus. The developer carrier is placed so as to overlap with the container opening. Part of the developer carrier is exposed outside the developing device through the container opening. The developer carrier is enabled to carry, on its outer circumferential surface, toner contained in the development container. The part of the developer carrier exposed from the container opening is opposed to the image carrier, and there is formed a development area where toner within the development container is fed to the image carrier.

Among such developing devices as described above is one in which a restricting blade is placed upstream of the development area in a rotational direction of the developer carrier. Of the restricting blade, an entire range along a rotation-axial direction of the developer carrier is protruded toward an outer circumferential surface of the developer carrier. A tip end of the restricting blade is in contact with or proximity to the outer circumferential surface of the developer carrier. The restricting blade restricts layer thickness of the developer carried on the developer carrier.

The development container of such a developing device as described above has a pair of side wall portions opposed to each other with the restricting blade interposed therebetween in the rotation-axial direction. An inner surface of each side wall portion in the rotation-axial direction forms a side surface out of inner surfaces of the development container. An end edge of the restricting blade in the rotation-axial direction is opposed to the side wall portion and the rotation-axial direction.

SUMMARY

A developing device according to one aspect of the present disclosure includes a development container, a developer carrier, and a restricting blade. The development container has an opening and internally contains developer including toner. The developer carrier is rotatably supported by the development container and has a development area where part of an outer circumferential surface carrying the developer is exposed from the opening in opposition to an image carrier, and the developer carrier feeds the toner to the image carrier in the development area. The restricting blade is placed on an upstream side of the development area in a rotational direction of the developer carrier, and restricts layer thickness of the developer carried by the developer carrier. The development container includes a pair of side frames fitted at both end portions of the development container in its rotation-axial direction of the developer carrier to support the developer carrier, and a pair of side wall portions located inward of the pair of side frames in the rotation-axial direction and facing the rotation-axial direction with the restricting blade interposed therebetween. In each of the pair of side wall portions, a seal member insertion hole extending through along the rotation-axial direction is formed at a position facing an end edge of the restricting blade in the rotation-axial direction. The developing device includes a blade-side side seal which is inserted in the seal member insertion hole to block a gap between the restricting blade and the side wall portion.

DETAILED DESCRIPTION

Figure 1:
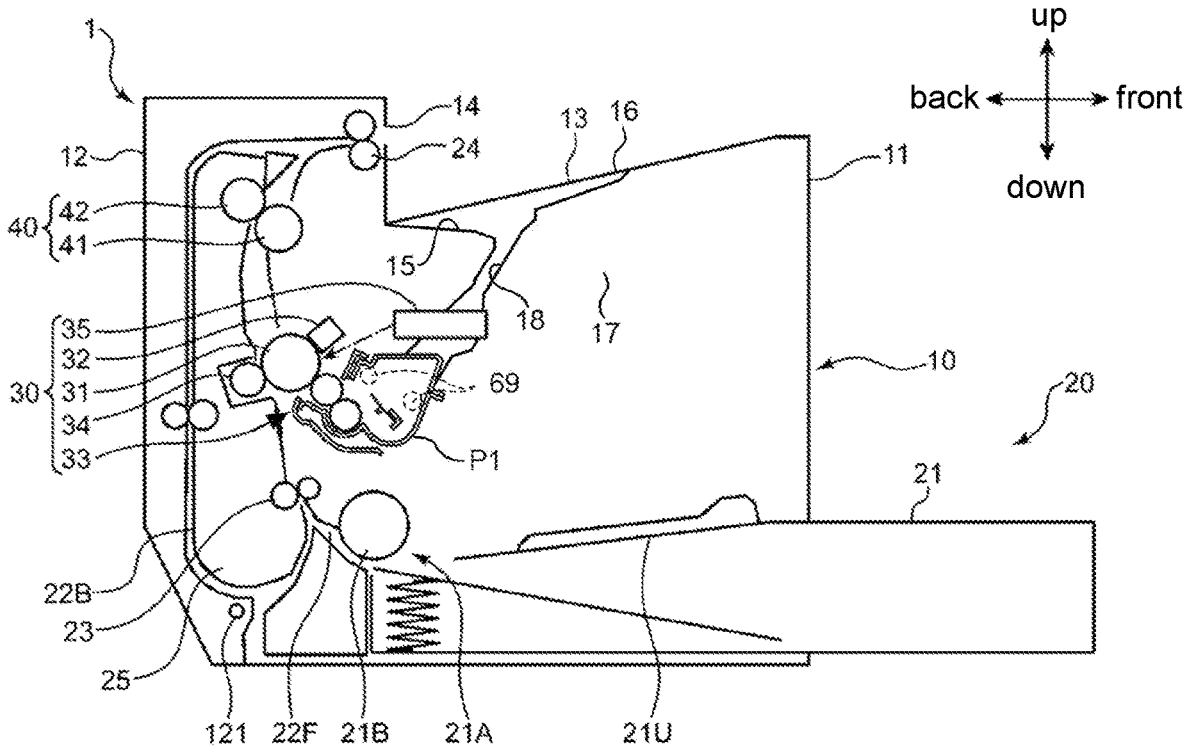
FIG. 1 is a side sectional view showing a schematic configuration of an image forming apparatus of the present disclosure.

Hereinbelow, an embodiment of the present disclosure will be described with reference to the accompanying drawings. FIG. 1 is a side sectional view showing a schematic configuration of an image forming apparatus 1 of the disclosure. It is noted that right side in FIG. 1 is assumed as front side of the image forming apparatus 1 and left side in FIG. 1 is assumed as rear side of the image forming apparatus 1. Also, upper side in FIG. 1 is assumed as upper side of the image forming apparatus 1, and lower side in FIG. 1 is assumed as lower side of the image forming apparatus 1.

As shown in FIG. 1, the image forming apparatus 1 (monochrome printer in this case) includes a body housing 10 (apparatus main body), a sheet feed part 20, an image forming part 30, a developing device 33, and a fixing part 40. The body housing 10 has a casing structure of a generally rectangular parallelepiped shape. The sheet feed part 20 is housed in the body housing 10.d The body housing 10 is equipped with a front cover 11, a rear cover 12, a body opening 15, and an upper cover 16. The front cover 11 is located on a front-face side of the body housing 10. The rear cover 12 is located on a rear-face side of the body housing 10. The body opening 15 is formed in upper portion of the body housing 10. The upper cover 16 is provided at a top face of the body housing 10. The upper cover 16 is enabled to open and close the body opening 15. Opening the upper cover 16 allows a user to access inside of the body housing 10 through the body opening 15.

A sheet discharge part 13 to which a sheet (recording medium) over image formation is to be discharged is provided on an upper surface of the upper cover 16. At an upper site of the body housing 10, a sheet discharge port 14 is provided in front-and-rear opposition to the sheet discharge part 13. The sheet discharge port 14 is an opening leading to inside of the housing 10. It is noted that the term 'sheet' hereinafter refers to copying paper, coated paper, OHP sheets, cardboards, postcards, tracing paper, and other sheet materials for image formation process.

The developing device 33 can be set into and out of the body opening 15 under a condition that the upper cover 16 is opened. Individual units (except the developing device 33) of the image forming part 30 and the fixing part 40 can be set into and out of the body housing 10 from its rear-face side under a condition that the rear cover 12 is opened.

The sheet feed part 20 includes a sheet feed cassette 21. The sheet feed cassette 21 contains sheets to be subjected to image formation process. Part of the sheet feed cassette 21 is protruded forward of a front face of the body housing 10. A top face of a housed portion of the sheet feed cassette 21 housed within the body housing 10 is covered with a sheet-feed-cassette top plate 21U.

The sheet feed cassette 21 includes a sheet containing space in which a bundle of sheets is to be contained, a lift plate for lifting up a bundle of sheets for sheet feeding, and the like. A sheet feed-out part 21A is provided at a rear-end side upper position of the sheet feed cassette 21. A sheet feed roller 21B for feeding out sheets, one by one, of a topmost layer of a sheet bundle in the sheet feed cassette 21 is placed in the sheet feed-out part 21A.

The image forming part 30 performs image forming operation. The image forming operation is an operation of forming a toner image (developer image) on a sheet fed out from the sheet feed part 20. The image forming part 30 includes a photosensitive drum 31, and other members disposed around the photosensitive drum 31 such as a charging unit 32, an exposure unit 35, the developing device 33, and a transfer roller 34. The developer used for image formation is a nonmagnetic one-component developer composed of toner alone.

The photosensitive drum 31 (image carrier) includes a rotating shaft, and an outer circumferential surface rotatable around the rotating shaft. A photosensitive layer formed from a well-known organic photoconductor (OPC) and having an outer circumferential surface composed of a charge generation layer, a charge transport layer or the like, as an example, is formed at an outer circumferential surface of the photosensitive drum 31. The photosensitive layer, after uniformly charged by a later-described charging unit 32, is illuminated by the exposure unit 35, by which an electrostatic latent image with charging level attenuated is formed. Then, a toner image elicited from the electrostatic latent image by the developing device 33 is carried thereon.

The charging unit 32 (charging device), which is placed with a specified gap to the outer circumferential surface of the photosensitive drum 31, electrically charges uniformly, in a noncontact state, the outer circumferential surface of the photosensitive drum 31. More specifically, the charging unit 32 includes a charging wire 321 and a grid electrode 322 (see FIG. 3 for both). The charging wire 321, which is a linear electrode extending along a rotation-axial direction of the photosensitive drum 31, generates corona discharge against the photosensitive drum 31. The grid electrode 322, which is a grid-shaped electrode extending along the rotation-axial direction of the photosensitive drum 31, is disposed between the charging wire 321 and the photosensitive drum 31.

The charging unit 32 makes a current flow of a specified current value through the charging wire 321 to thereby generate corona discharge. Moreover, the charging unit 32 applies a specified voltage to the grid electrode 322 so that the outer circumferential surface of the photosensitive drum 31 opposed to the grid electrode 322 is charged uniformly to a specified surface potential.

The exposure unit 35 (exposure device) includes a laser light source and optical equipment such as a mirror and a lens. The exposure unit 35 applies, to the outer circumferential surface of the photosensitive drum 31, light modulated based on image data given from an external device such as a personal computer. As a result, on the outer circumferential surface of the photosensitive drum 31, the exposure unit 35 forms an electrostatic latent image corresponding to an image based on the image data.

The transfer roller 34 includes a rotating shaft parallel to a widthwise direction of a sheet, and an outer circumferential surface opposed to the outer circumferential surface of the photosensitive drum 31. The transfer roller 34 is supported by the body housing 10 so as to be rotatable around the rotating shaft. The transfer roller 34 transfers a toner image carried on the outer circumferential surface of the photosensitive drum 31 to a sheet passing through a nip portion against the outer circumferential surface of the photosensitive drum 31. During this transfer, a transfer voltage opposite in polarity to toner is applied to the transfer roller 34.

The fixing part 40, which is located sheet-conveyance downstream of the transfer roller 34, fixes the toner image, which has been transferred to the sheet, on the sheet. The fixing part 40 includes a fixing roller 41 and a pressure roller 42. The fixing roller 41, including a heat source inside, heats the toner transferred to the sheet to a specified temperature. The pressure roller 42, set in pressure contact with the fixing roller 41, forms a fixing nip portion against the fixing roller 41. When the sheet to which a toner image has been transferred is passed through the fixing nip portion, the toner image is fixed on the sheet by means of heating by the fixing roller 41 and pressurization by the pressure roller 42.

The body housing 10 is internally equipped with a main conveyance path 22F and a reversal conveyance path 22B. The main conveyance path 22F and the reversal conveyance path 22B convey a sheet. The main conveyance path 22F extends from the sheet feed-out part 21A of the sheet feed part 20, via the image forming part 30 and the fixing part 40, up to the sheet discharge port 14. The reversal conveyance path 22B is a conveyance path for, in a case of double-sided printing with a sheet, returning the sheet, which has been subjected to one-side printing, to upstream side of the image forming part 30 in the main conveyance path 22F.

The main conveyance path 22F extends so as to pass from below toward above through a transfer nip portion formed by the photosensitive drum 31 and the transfer roller 34. Also, a registration roller pair 23 is placed upstream of the transfer nip portion in the main conveyance path 22F. The sheet is once stopped by the registration roller pair 23, then subjected to skew correction and subsequently fed out to the transfer nip portion at a specified timing for image transfer. A plurality of conveyance rollers for conveying a sheet are placed on the main conveyance path 22F and the reversal conveyance path 22B. A sheet discharge roller pair 24 is placed near the sheet discharge port 14.

The reversal conveyance path 22B is formed between an outer surface of a reversal unit 25 and an inner surface of the rear cover 12 of the body housing 10. It is noted that the transfer roller 34 and one roller of the registration roller pair 23 are mounted on an inner surface of the reversal unit 25. The rear cover 12 and the reversal unit 25 are each pivotable around an axis of a fulcrum part 121 provided at a lower end of those members. In an event of jam (paper jamming) in the reversal conveyance path 22B, the rear cover 12 is opened. In an event of jam in the main conveyance path 22F or when a unit of the photosensitive drum 31 or the developing device 33 is to be removed outside, not only the rear cover 12 but also the reversal unit 25 are opened.

As shown in FIG. 1, in the body housing 10, guide rails 18 are formed at a pair of side surfaces 17 opposed to each other in the sheet widthwise direction (drawing-sheet direction in FIG. 1). The guide rails 18 have a rail structure recessed in the sheet widthwise direction. The guide rails 18 extend downward from the body opening 15 to a fitting position P1 where the developing device 33 is fitted to the body housing 10.

Figure 2:
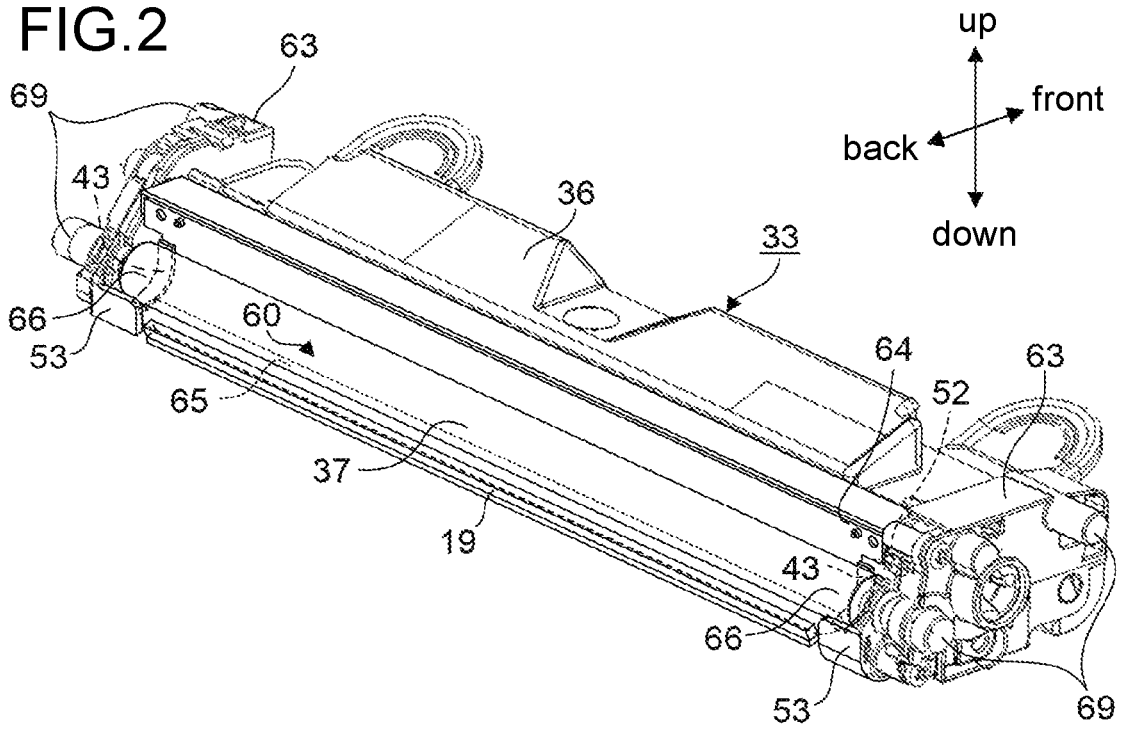
FIG. 2 is a perspective view showing an entirety of a developing device.
Figure 3:
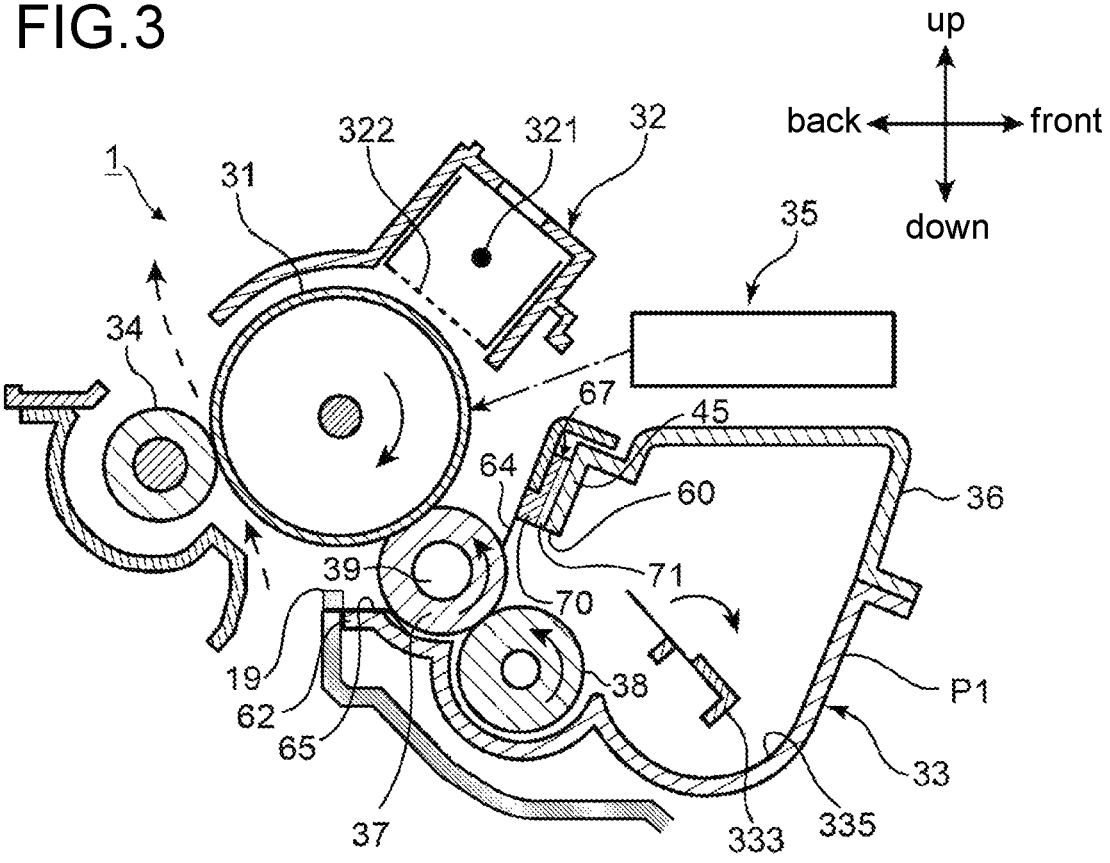
FIG. 3 is an enlarged sectional view in which a vicinity of a photosensitive drum and the developing device is enlarged.
Figure 4:
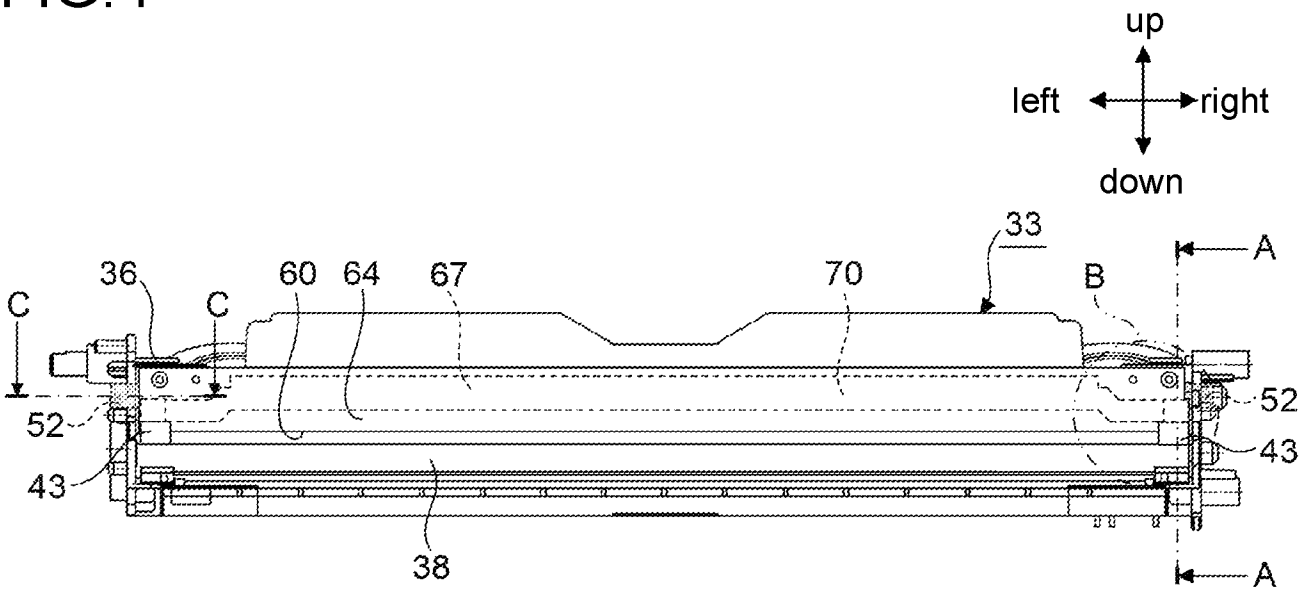
FIG. 4 is a plan view showing the developing device in which a developing roller and side frames have been removed from a development container.

FIG. 2 is a perspective view showing an entirety of the developing device 33. FIG. 3 is an enlarged sectional view in which a vicinity of the photosensitive drum 31 and the developing device 33 is enlarged. FIG. 4 is a plan view showing the developing device 33 in which a developing roller 37 (see FIG. 2) and side frames 63 (see FIG. 2) have been removed from a development container 36.

As shown in FIGS. 2, 3 and 4, the developing device 33 includes the development container 36, the developing roller 37 (developer carrier), a feed roller 38, a stirring paddle 333, and guide parts 69.

The development container 36 internally contains nonmagnetic one-component developer composed of toner alone and also contains the developing roller 37, the feed roller 38, and the like. The development container 36 includes a stirring chamber 335, a container opening 60 (opening), and side frames 63. The stirring chamber 335 contains developer in a stirred state.

The container opening 60 is located rearward of the stirring chamber 335 in a front/rear direction. The container opening 60 is a rectangular-shaped through hole opened on a rear side (a side closer to the photosensitive drum 31) of the development container 36. The container opening 60 is formed elongated in the widthwise direction (axial direction) of the developing device 33.

The developing roller 37 is provided inside the container opening 60 so as to overlap with the container opening 60. Part of an outer circumferential surface of the developing roller 37 is exposed from the container opening 60 outward of the development container 36. The developing roller 37 includes a rotating shaft 39 extending along the widthwise direction of the developing device 33 (sheet widthwise direction). The rotating shaft 39 is rotatably supported by the development container 36. In other words, the developing roller 37 is supported by the development container 36 via the rotating shaft 39 so as to be rotatable counterclockwise around the rotating shaft 39 as in the figure (see FIG. 3). It is noted that hereinafter, a direction along the rotating shaft 39 will be referred to as 'axial direction (rotation-axial direction)'. Also, a rotational direction around the rotating shaft 39 of the developing roller 37 will be referred to as 'rotational direction'.

The developing roller 37 is enabled to carry toner on its outer circumferential surface. While the developing device 33 is in the fitting position P1, the part of the developing roller 37 exposed out of the container opening 60 and the outer circumferential surface of the photosensitive drum 31 are opposed to and in contact with each other. In this state, the developing roller 37 is enabled to feed the nonmagnetic one-component toner (developer) to the photosensitive drum 31.

The feed roller 38, which is provided between the developing roller 37 and the stirring paddle 333, feeds the nonmagnetic one-component toner (developer) to the outer circumferential surface of the developing roller 37. The stirring paddle 333, which is provided in the stirring chamber 335, stirs the developer inside the stirring chamber 335.

As shown in FIGS. 2 and 3, provided around the container opening 60 are a flat portion 62, a front seal member 65, presser members 43, a restricting blade 64, and a blade seal member 67. The flat portion 62 is located on a rear side (a side closer to the photosensitive drum 31) of the container opening 60. The front seal member 65 is stacked on the flat portion 62. The presser members 43 are provided at both end portions in the axial direction of the developing roller 37. The restricting blade 64 is fixed at a rear-side end portion of the development container 36. The blade seal member 67 is layered on a back-face side of the restricting blade 64.

The flat portion 62 is a plane adjacently connecting with a part of the inner surface of the development container 36 that is located under the developing roller 37. The flat portion 62 extends rearward (a direction nearing to the photosensitive drum 31) from the container opening 60. While the developing device 33 is in the fitting position P1, the flat portion 62 remains generally horizontal.

The front seal member 65 is a rectangular-shaped sheet formed from PET film or the like. The front seal member 65 is layered on the flat portion 62 and bonded to the development container 36 with adhesive or the like. The front seal member 65 is formed elongated in the axial direction. The front seal member 65 extends between both end portions 66 of the developing roller 37 along the axial direction.

Out of both end edges of the front seal member 65 in the front/rear direction (a direction perpendicular to the sheet widthwise direction), one end edge closer to the developing roller 37 (feed roller 38) is in contact with an entire range of a developer-carrying area out of the outer circumferential surface of the developing roller 37 as viewed in the axial direction. The front seal member 65, by its contacting the outer circumferential surface of the developing roller 37, blocks a gap between the development container 36 and the developing roller 37, thereby suppressing outflow of the developer contained in the development container 36.

The front seal member 65 includes a first shielding portion 19. The first shielding portion 19 is raised in a planar direction of the front seal member 65 from one end edge farther from the developing roller 37 (feed roller 38) out of both end edges in the front/rear direction (a direction perpendicular to the sheet widthwise direction). The first shielding portion 19 is protruded upward over an entire axial range of an end edge of the front seal member 65. The first shielding portion 19 has a square shape formed from sponge or the like. The first shielding portion 19 is bonded to a surface of the front seal member 65 with adhesive or the like. The first shielding portion 19 holds a slight amount of developer having flowed out of the gap between the developing roller 37 and the development container 36 so that the slight amount of developer is kept from dropping outward of the developing device 33.

Outside axial both end portions of the first shielding portion 19, platy second shielding portions 53 are provided so as to be protruded upward. The second shielding portion 53 are located so as to overlap with the presser members 43 in the axial direction. The second shielding portions 53 are formed integrally with later-described side frames 63, respectively. With each side frame 63 fitted to the development container 36, each second shielding portion 53 extends from the side frame 63 toward the first shielding portion 19 along the axial direction.

Figure 5:
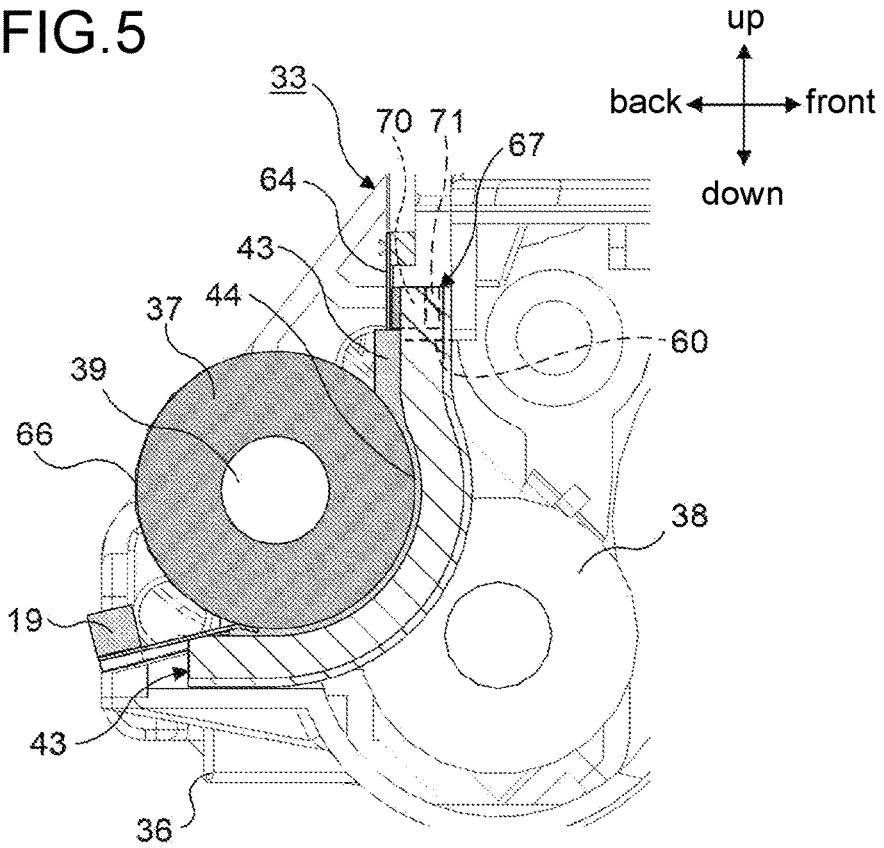
FIG. 5 is a side sectional view of the developing device cut along an A-A cross-sectional line shown in FIG. 4.
Figure 6:
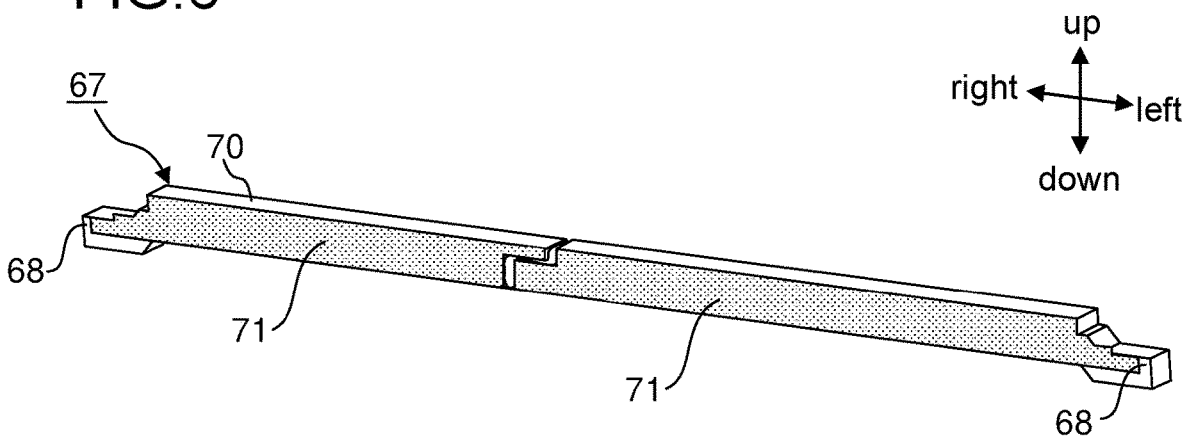
FIG. 6 is a perspective view showing a blade seal member.
Figure 7:
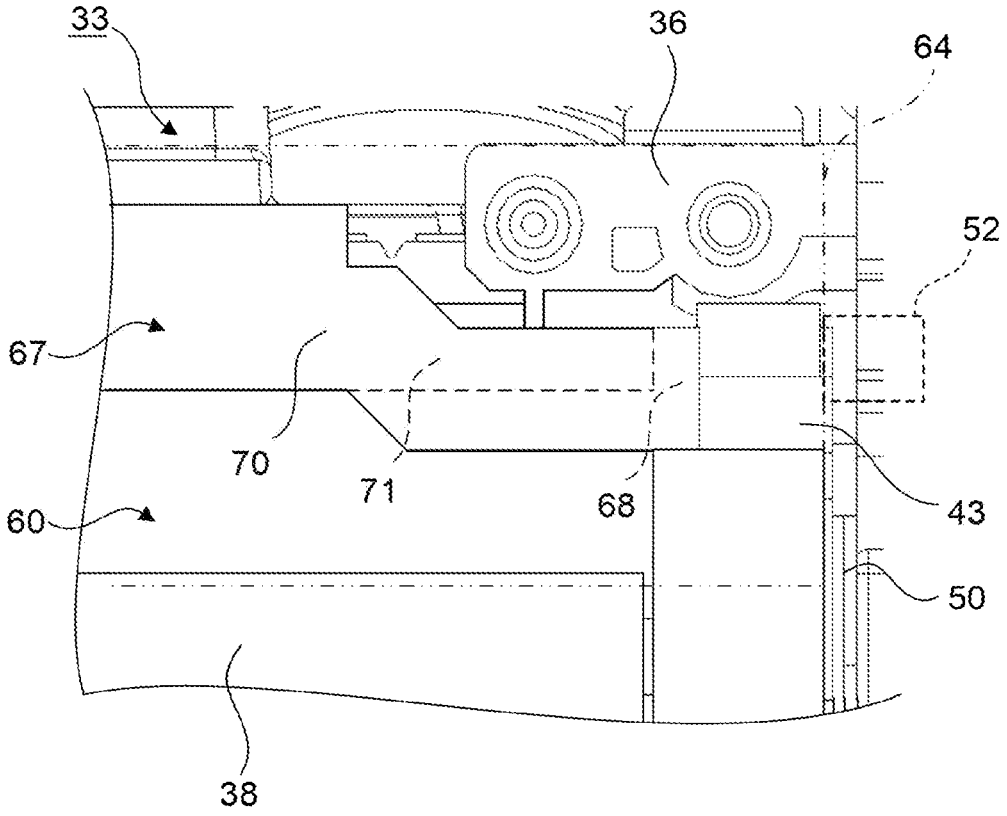
FIG. 7 is a partially enlarged view in which a vicinity of an end portion of the blade seal member in the developing device is enlarged.
Figure 8:
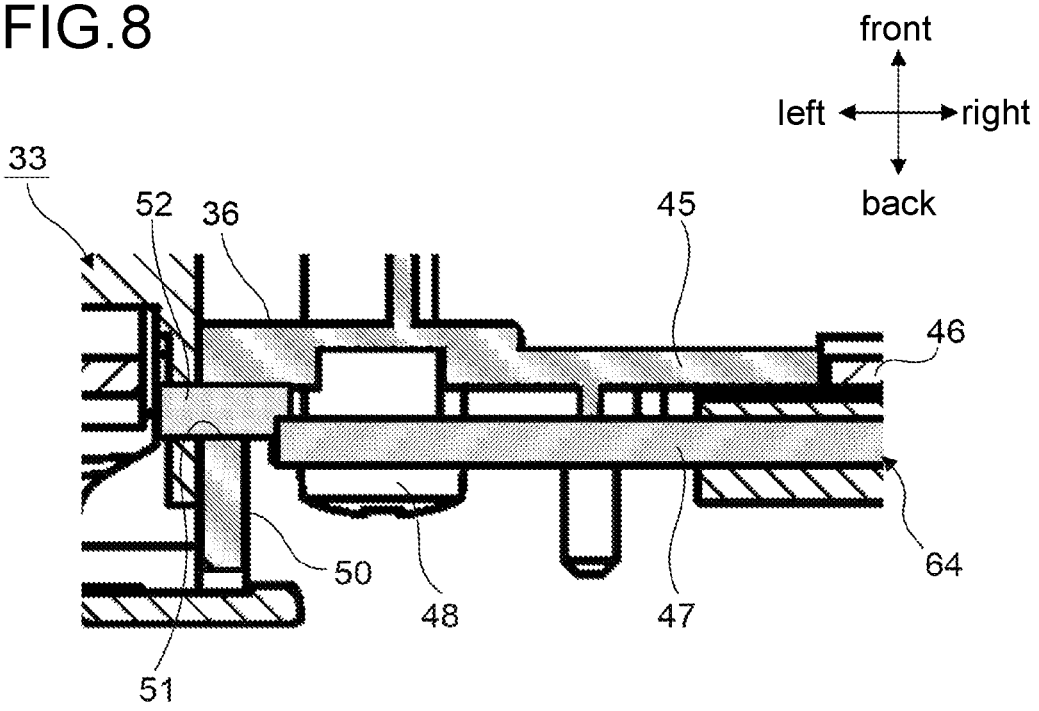
FIG. 8 is a partially enlarged sectional view in which a cross section of the developing device cut along a C-C cross-sectional line shown in FIG. 4 is enlarged.

FIG. 5 is a side sectional view of the developing device 33 cut along an A-A cross-sectional line shown in FIG. 4. FIG. 6 is a perspective view showing the blade seal member 67. FIG. 7 is a partially enlarged view in which a vicinity of an end portion of the blade seal member 67 of the developing device 33 (a region surrounded by a circle B of two-dot chain line in FIG. 4) is enlarged. FIG. 8 is a partially enlarged sectional view in which a cross section of the developing device 33 cut along a C-C cross-sectional line shown in FIG. 4 is enlarged. It is noted that the blade seal member 67 shown in FIG. 6 is depicted as the blade seal member 67 shown in FIG. 4 is front-and-rear reversed, where FIG. 4 and FIG. 6 are reverse to each other in the left/right direction.

The presser members 43 are located so as to overlap with both-side end portions of the container opening 60, respectively, in the axial direction (see FIG. 2).

As shown in FIG. 5, each presser member 43 has a presser surface 44. The presser surface 44 is a curved surface which is concaved forward (toward the stirring chamber 335) along the outer circumferential surface of the developing roller 37. The presser surfaces 44 are opposed to outer circumferential surfaces of both end portions 66, respectively, of the developing roller 37 in the radial direction of the developing roller 37.

Each presser member 43 is formed with its thickness larger than a gap between the outer circumferential surface of the developing roller 37 and the inner surface of the development container 36. As a result of this, when the developing roller 37 is fitted to the development container 36, the presser surface 44 is brought into contact with the outer circumferential surface of the developing roller 37, causing the developing roller 37 to be pressed in its radial direction. Contact and pressurization of the presser surfaces 44 against both end portions 66 causes blockage of the gap between both end portions 66 and the development container 36, by which outflow of the developer from inside the development container 36 is suppressed.

Each presser member 43 has a multilayer structure (two-layer structure in this case) in which a plurality of sheet matters are layer-stacked in the radial direction of the developing roller 37. Out of the multilayered sheet matters, at least the sheet matter radially closest to the developing roller 37 is a sheet matter of polytetrafluoroethylene. On a surface of this sheet matter, the presser surface 44 is formed. Other sheet matters out of the multilayered sheet matters are formed from sponge or other urethane foams.

As shown in FIGS. 3 and 8, a counter-to-blade portion 45 is formed in the development container 36. The counter-to-blade portion 45 is a portion upward of an opening edge of the container opening 60. The counter-to-blade portion 45 faces a rotational-direction upstream-side surface (a forward surface in the front/rear direction) of the restricting blade 64. The counter-to-blade portion 45 is formed flat in the axial direction.

The restricting blade 64 is a rectangular-shaped platy matter which is formed elongated in the axial direction (see FIG. 2). The restricting blade 64 is composed of a stationary part 46 and a restricting part 47. The stationary part 46 is an L-shaped-in-side-view metallic platy matter having a bent portion which is bent generally orthogonal. The stationary part 46 is placed so as to face the counter-to-blade portion 45 in the rotational direction.

The restricting part 47 is a rectangular-shaped metallic platy matter which is formed elongated in the axial direction. An upper end portion of the restricting part 47 is layered and welded on a rotational-direction downstream-side (photosensitive drum 31 side) surface of the stationary part 46. The restricting part 47 is protruded from a lower end portion (the end portion of the stationary part 46 closest to the developing roller 37 in the up/down direction) of the stationary part 46 toward the developing roller 37 (see FIG. 3).

A tip end portion of the restricting part 47 in its protrusive direction is placed in contact with the outer circumferential surface of the developing roller 37. Toner fed onto the developing roller 37 enters in between the restricting part 47 and the developing roller 37 along with rotation of the developing roller 37 and then, while being frictionally charged, is carried on the developing roller 37 as a thin layer of a certain thickness.

At a layer-stacking spot of the stationary part 46 and the restricting part 47 in the restricting blade 64, a through hole is formed so as to extend through the stationary part 46 and the restricting part 47 along a planar direction (thickness-wise direction) of the stationary part 46. The stationary part 46 is fixed to the counter-to-blade portion 45 by means of a tightening member 48 composed of a bolt or the like inserted through this through hole (see FIG. 8).

The blade seal member 67 is provided between the restricting blade 64 and the development container 36 in the rotational direction (a direction perpendicular to the axial direction). The blade seal member 67 is placed between a pair of presser members 43 in the axial direction (see FIG. 4). The blade seal member 67 is composed of a multilayer sheet including a first layered material 70 and a second layered material 71 layer-stacked in the front/rear direction.

As shown in FIGS. 4, 5, 6 and 7, the first layered material 70 is formed from urethane foam or other sponge into a square shape. The first layered material 70 is formed elongated in the axial direction. More specifically, the first layered material 70 is formed in a way that axially juxtaposed two seal members (first seal member 72 and second seal member 73) are bonded together at an axially central portion with adhesive or the like.

The first layered material 70 is layered on surfaces of the stationary part 46 and the restricting part 47 farther from the photosensitive drum 31 (surfaces on the rotational-direction upstream side of the developing roller 37). On a rotational-direction downstream-side (front/rear-direction rear-side) surface of the first layered material 70, double-sided tape having an adhesive component on both-side surfaces is stuck. In other words, double-sided tape is set between the first layered material 70 and the restricting part 47. By means of this double-sided tape, the first layered material 70 is bonded to the restricting part 47.

The second layered material 71 is a sheet material elongated in the axial direction. The second layered material 71 is formed from polyethylene terephthalate (PET). The second layered material 71 is larger in rigidity than the first layered material 70. As shown in FIGS. 5 and 6, the second layered material 71 is layered on a surface of the first layered material 70 opposite to its contacting surface with the restricting blade 64 (on a surface farther from the developing roller 37 in the front/rear direction). The second layered material 71 is bonded to the first layered material 70 with adhesive or the like.

An axial length of the second layered material 71 is smaller than an axial length of the blade seal member 67. As viewed in the axial direction, both end portions of the second layered material 71 are located inward of both end portions of the blade seal member 67. Cushion parts 68 are formed, respectively, at regions ranging from axial both end portions of the blade seal member 67 to both end portions of the second layered material 71.

Each cushion part 68 is a part of the first layered material 70 protruded from the second layered material 71. The cushion part 68 is set in axial pressure contact with the presser member 43 to block a gap between the blade seal member 67 and the presser member 43. A pressure-contact area between the cushion part 68 and the presser member 43 is located inside the end edge of the restricting blade 64 as viewed in the axial direction.

Figure 9:
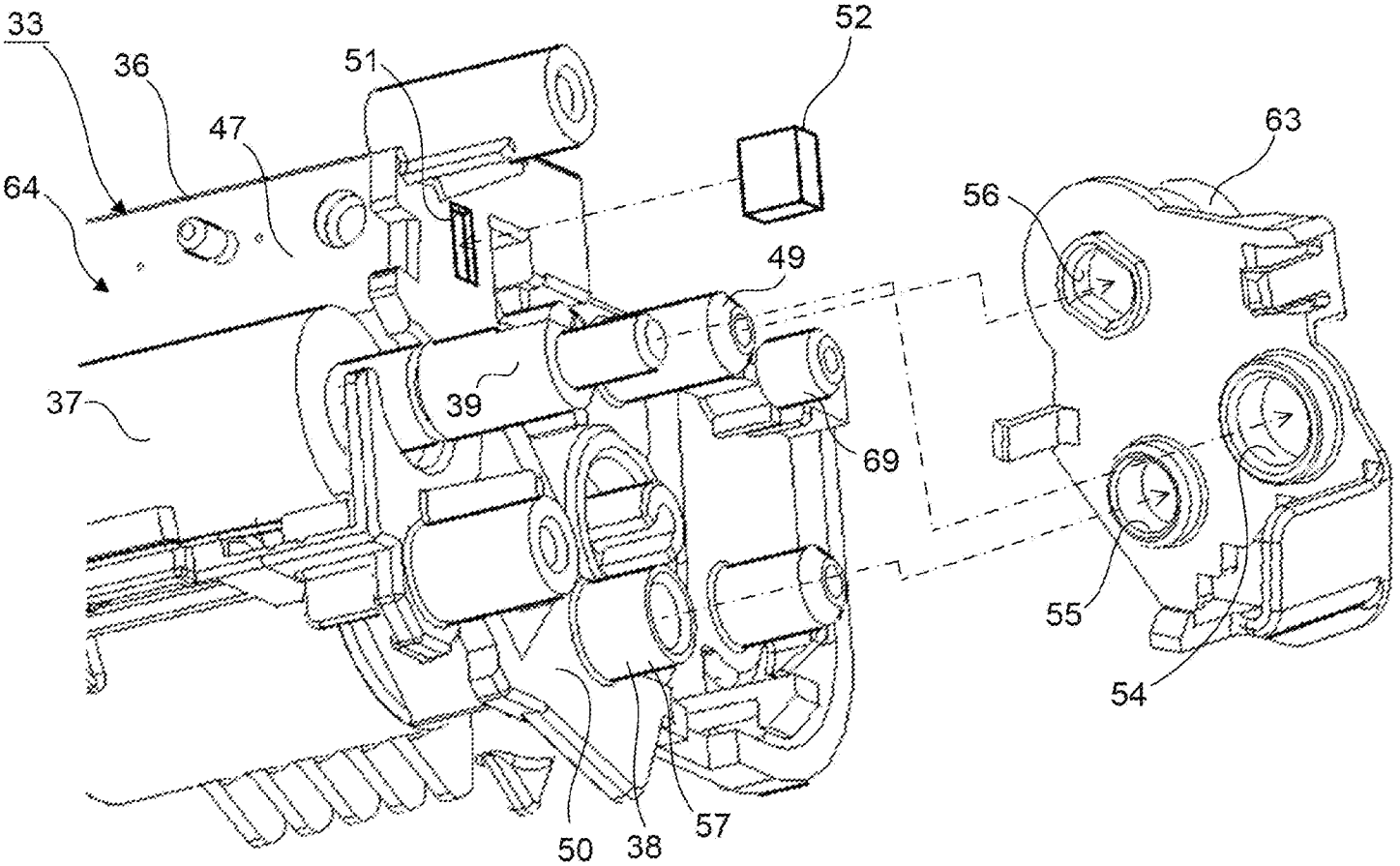
FIG. 9 is a perspective view showing the developing device with a side frame removed.

FIG. 9 is a perspective view showing the developing device 33 with the side frames 63 removed.

As shown in FIG. 9, a pair of side wall portions 50 raised upward from a bottom portion of the development container 36 are provided at axial both end portions of the development container 36. The side wall portions 50 are opposed to each other with the restricting blade 64 interposed therebetween in the axial direction. The developing roller 37 and the feed roller 38 extend axially through the side wall portions 50.

In each of the pair of side wall portions 50, a seal member insertion hole 51 extending axially therethrough is formed at a position facing an axial end edge of the restricting blade 64. The seal member insertion hole 51 is located at such a position as to overlap with the stationary part 46 of the restricting blade 64 in the up/down direction. The seal member insertion hole 51 is located rearward of the restricting part 47 in the front/rear direction.

As shown in FIG. 9, the side frames 63 are fitted axially outside the side wall portions 50, respectively. Each side frame 63 includes a developing-roller retaining hole 54, a feed-roller retaining hole 55, and a positioning hole 56. The developing-roller retaining hole 54, the feed-roller retaining hole 55, and the positioning hole 56 are through holes extending axially through the side frame 63.

An inner diameter of the developing-roller retaining hole 54 is larger than a diameter of the rotating shaft 39 of the developing roller 37. The rotating shaft 39 is inserted in the developing-roller retaining hole 54 so as to be retained rotatable relative to the side frame 63. An inner diameter of the feed-roller retaining hole 55 is larger than a diameter of a rotating shaft 57 of the feed roller 38 (see FIG. 3). The rotating shaft 57 is inserted in the feed-roller retaining hole 55 so as to be retained rotatable relative to the side frame 63.

A positioning protrusion 49 is provided at an axially outer end portion of the development container 36. The positioning protrusion 49 is protruded axially outward of the development container 36. Each side frame 63 is positioned by the positioning protrusion 49 being inserted in the positioning hole 56.

Each guide part 69 is a cylindrical-shaped protrusion protruded from the side wall portion 50 axially outward of the side frame 63. The guide parts 69 are engageable with the guide rails 18 (see FIG. 1). With the guide parts 69 engaged with the guide rails 18, the developing device 33 is made movable between the body opening 15 and the fitting position P1 along the guide rails 18 (see FIG. 1).

The developing device 33, while fitted to the body housing 10 in the fitting position P1, feeds toner to the outer circumferential surface of the photosensitive drum 31. As a result, an electrostatic latent image formed on the outer circumferential surface of the photosensitive drum 31 is developed (a toner image (visible image) elicited from an electrostatic latent image is formed).

A blade-side side seal 52 is inserted in the seal member insertion hole 51. The blade-side side seal 52 is formed from elastic material (preferably, urethane foam or other sponge). The blade-side side seal 52, as it is before provided in the developing device 33, is square-shaped as shown in FIG. 9. A thickness of the blade-side side seal 52 in the front/rear direction is larger than a size of the seal member insertion hole 51 in the front/rear direction. A size of the blade-side side seal 52 in the left/right direction is larger than an axial gap between each side frame 63 fitted to the side wall portion 50 and an axial end edge of the restricting blade 64.

As shown in FIG. 9, in the development container 36 before the side frames 63 are fitted thereto, axial outer surfaces of the side wall portions 50 are exposed outside. For this reason, after the restricting blade 64 has been fixed to the development container 36 and before the side frames 63 are fitted to the development container 36, each blade-side side seal 52 can be inserted into the seal member insertion hole 51 from axial outside of the side wall portion 50.

With each blade-side side seal 52 inserted in the seal member insertion hole 51, fitting the side frame 63 to the side wall portion 50 causes the axial inner surface of the side frame 63 to be brought into pressure contact with the blade-side side seal 52.

As a result of this, the blade-side side seal 52, while positioned between the restricting blade 64 and the side wall portion 50, is nipped and compressed between the side frame 63 and the end edge of the restricting blade 64. Thus, any gap between the restricting blade and the side wall portion 50 can be prevented.

Also in this state, the blade-side side seal 52 is positioned axially a pressure-contact area between the cushion part 68 and the presser member 43 (see FIG. 7).

As described above, at each opposite position where the pair of side wall portions 50 are opposed to the restricting blade 64, the seal member insertion hole 51 extending axially therethrough is formed. Therefore, even after the restricting blade 64 has been fixed to the development container 36, the blade-side side seal 52 can be inserted into the seal member insertion hole 51 before fitting of the side frame 63. Then, by the fitting of the side frame 63, it becomes possible to properly place the blade-side side seal 52 at a position between the end edge of the restricting blade 64 and the side wall portion 50. For this reason, positioning of the blade-side side seal 52 is facilitated, so that degradation of assemblability of the developing device 33 can be suppressed. Also, the blade-side side seal 52 blocks the gap between each side frame 63 and the restricting blade 64. Because of this, outflow of the developer can be suppressed.

Accordingly, the developing device 33 capable of suppressing outflow of the developer while suppressing increases in manufacturing cost can be provided.

Also as described above, fitting each side frame 63 to the development container 36 causes the blade-side side seal 52 to be pinched between the axial end edge of the restricting blade 64 and the side frame 63. As a result of this, sealability of the blade-side side seal 52 can be improved without degrading the assemblability. Thus, it is implementable to suppress outflow of the developer more preferably while suppressing any increases in the manufacturing cost.

Also as described above, the blade-side side seal 52, by virtue of being formed from elastic material, is preferably compressed while pinched between the restricting blade 64 and the side frame 63. As a result, sealability of the blade-side side seal 52 can be improved.

Also as described above, the blade-side side seal 52 is in contact with the stationary part 46 of the restricting blade 64. The stationary part 46 is larger in thickness and higher in rigidity than the restricting part 47. As a result of this, the blade-side side seal 52 is more preferably compressed, so that the sealability can be improved.

Also as described above, the second layered material 71 is higher in rigidity than the first layered material 70. By virtue of this, the first layered material 70 becomes less likely to be bent with the second layered material 71 serving as a prop.

Therefore, when the first layered material 70 is bonded to the restricting blade 64 (stationary part 46 and restricting part 47), a bonding surface of the first layered material 70 to the restricting part 47 can be made less likely to be wrinkled or bent. Accordingly, it becomes less likely that a gap occurs between the first layered material 70 and the restricting part 47, so that outflow of the developer can be suppressed more preferably.

Also as described above, the cushion parts 68 are formed at both end portions of the first layered material 70. For this reason, when both end portions of the first layered material 70 are brought into contact with the presser members 43, respectively, the cushion part 68 is compressed. Then, areas (cushion part 68) of the first layered material 70 to be in contact with the presser members 43 are increased in compressibility, sealability between the first layered material 70 and the presser members 43 can be enhanced. Therefore, outflow of the developer can be suppressed more preferably.

Also as described above, each blade-side side seal 52 is located axially outside the pressure-contact area between the cushion part 68 and the presser member 43. For this reason, even in a case where a gap has occurred between the cushion part 68 and the presser member 43 so that the developer flows into the back surface of the restricting blade 64 through the gap, going inwardly toward an opposing portion between the end edge of the restricting blade 64 and the side wall portion 50, the developer is held back by the blade-side side seal 52. Therefore, outflow of the developer through between the restricting blade 64 and the side wall portion 50 can be suppressed.

Also, the first shielding portion 19 is provided so as to be protruded upward over an entire range of a longitudinal end edge of the front seal member 65. For this reason, even with waste toner deposited around the container opening 60, when the developing device 33 is oriented downward in its fitting to the body housing 10, the waste toner around the container opening 60 is held back by the first shielding portion 19. Therefore, dropping of waste toner into the body housing 10 can be suppressed.

Also as described above, each second shielding portion 53 is located so as to overlap with the presser member 43 in the axial direction. For this reason, even when a slight amount of developer has flowed out through a gap between the presser member 43 and the developing roller 37, outflow of the developer outward of the development container 36 can be prevented by the second shielding portion 53. Further as described above, the second shielding portion 53 is formed integrally with the side frame 63. Therefore, simultaneously with the fitting of the side frame 63, the second shielding portion 53 is positioned as well to a specified position. Thus, assembly man-hours involved can be reduced, so that manufacturing cost can be suppressed.

In addition to the above description, the present disclosure is not limited to the above-described embodiment, and may be modified in various ways unless those modifications depart from the gist of the disclosure. For example, whereas the foregoing embodiment has been described about a monochrome printer as an example of the image forming apparatus 1, the disclosure may also be applied to tandem- or rotary-type color printers as an example. Further, the disclosure may be applied to image forming apparatuses such as copiers, facsimiles or multifunction peripherals equipped with their functions as well.

In cases where the restricting blade 64 or the developing roller 37 is made interchangeable due to maintenance or other reasons, the side frames 63 may be removably fitted to the development container 36. In this case, for example, each side frame 63 may be so configured as to have a plurality of engaging portions each protruded along the axial direction with a claw shape formed at a tip end of the protruding direction. The side frame 63 is fitted to the development container 36 in a so-called snap-fit structure in which an engaging portion is engaged by the above-mentioned claw shape to a plurality of cutout portions formed in the development container 36.

Also, although each blade-side side seal 52 is pinched between the development container 36 and the side wall portion 50 as a result of fitting of the side frame 63, yet this is not limitative. For example, another configuration in which the blade-side side seal 52 is bonded to the restricting blade 64 may also be adopted.

Further, although the developer is assumed as nonmagnetic one-component developer composed of toner alone in the above-described embodiment, yet a two-component developer with use of toner and carrier may also be adopted.

The present disclosure is applicable to image forming apparatuses including a developing device which fulfills development with use of developer containing toner.

By virtue of exploiting the disclosure, there can be provided an image forming apparatus capable of suppressing outflow of the developer while suppressing increases in the manufacturing cost.

What is claimed is:

1. A developing device comprising:

a development container having an opening and internally containing developer including toner;

a developer carrier which is rotatably supported by he development container and has a development area where part of an outer circumferential surface carrying the developer is exposed from the opening in opposition to an image carrier, and which feeds the toner to the image carrier in the development area; and a restricting blade which is placed on an upstream side of the development area in a rotational direction of the developer carrier and which restricts layer thickness of the developer carried by the developer carrier, wherein the development container includes:

a pair of side frames fitted at both end portions of the development container in a rotation-axial direction of the developer carrier to support the developer carrier; and a pair of side wall portions which are located inward of the pair of side frames in the rotation-axial direction which face each other in the rotation-axial direction with the restricting blade interposed therebetween, the pair of side wall portions having seal member insertion holes formed therein, one at each of positions respectively facing end edges of the restricting blade with respect to the rotation-axial direction, the seal member insertion holes penetrating the side wall portions from one side to another side thereof with respect to the rotation-axial direction, and the developing device further includes a blade-side side seal which is inserted in the seal member insertion hole to block a gap between the restricting blade and the side wall portion.

2. The developing device according to claim 1, wherein the blade-side side seal is formed from elastic material and pinched between an end edge of the restricting blade in the rotation-axial direction and the side frame as a result of fitting of the side frame to the development container.

3. The developing device according to claim 2, wherein the blade-side side seal is sponge.

4. The developing device according to claim 1, wherein the restricting blade includes a stationary part fixed to the development container, and a restricting part protruded from the stationary part toward the developer carrier, and the blade-side side seal is in contact with the stationary part so as to block a gap between the stationary part and the side wall portion.

5. The developing device according to claim 1, wherein the developer is a nonmagnetic one-component developer composed of nonmagnetic toner alone.

6. An image forming apparatus comprising:

an apparatus body;

the image carrier provided inside the apparatus body and having an outer circumferential surface on which an electrostatic latent image is to be formed; and the developing device according to claim 1, which is removably provided inside the apparatus body and which, while fitted inside the apparatus body, develops the electrostatic latent image into a toner image with the developer carrier brought into contact with or proximity to the outer circumferential surface of the image carrier.

* * * * *